US007857604B2

(12) United States Patent
Shaw et al.

(10) Patent No.: US 7,857,604 B2
(45) Date of Patent: Dec. 28, 2010

(54) HERMETICALLY SEALED MOTOR LEAD TUBE

(75) Inventors: Chris K. Shaw, Tulsa, OK (US); Bradley Ellis Yingst, Anchorage, AK (US); Sean A. Cain, Owasso, OK (US); David H. Neuroth, Claremore, OK (US); Larry V. Dalrymple, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/207,625

(22) Filed: Sep. 10, 2008

(65) Prior Publication Data

US 2009/0068037 A1 Mar. 12, 2009

Related U.S. Application Data

(60) Provisional application No. 60/971,199, filed on Sep. 10, 2007.

(51) Int. Cl.
*F04B 17/03* (2006.01)
*H02K 5/10* (2006.01)
*H02K 5/12* (2006.01)

(52) U.S. Cl. ..... 417/422; 310/87

(58) Field of Classification Search ..... 417/423.7, 417/422; 310/87
See application file for complete search history.

(56) References Cited

U.S. PATENT DOCUMENTS

| | | | | |
|---|---|---|---|---|
| 3,980,369 | A | 9/1976 | Panek | |
| 4,262,226 | A * | 4/1981 | Erickson | 310/87 |
| 4,500,263 | A | 2/1985 | Mohn | |
| 4,667,737 | A | 5/1987 | Shaw et al. | |
| 5,269,377 | A | 12/1993 | Martin | |
| 6,202,743 | B1 | 3/2001 | Moore | |
| 6,511,335 | B1 * | 1/2003 | Rayssiguier et al. | 439/191 |
| 6,759,595 | B2 * | 7/2004 | Goehlich et al. | 174/168 |
| 7,150,325 | B2 | 12/2006 | Ireland et al. | |
| 7,565,932 | B2 | 7/2009 | Lawson | |
| 2005/0016735 | A1 * | 1/2005 | Ireland et al. | 166/352 |
| 2007/0046115 | A1 * | 3/2007 | Tetzlaff et al. | 310/71 |
| 2007/0235195 | A1 | 10/2007 | Lawson | |

* cited by examiner

*Primary Examiner*—Devon C Kramer
*Assistant Examiner*—Bryan Lettman
(74) *Attorney, Agent, or Firm*—Bracewell & Giuliani LLP

(57) ABSTRACT

An electrical submersible pump assembly has a motor cooperatively engaged with a pump for driving the pump and a motor lead extending to the motor for supplying power to the motor. The motor lead has an electrical conductor enclosed within a tube. The tube is sealed from an exterior environment of the motor and contains a dielectric fluid. The motor may be filled with a dielectric lubricant and the interior of the tube of the motor lead may be in fluid communication with the dielectric lubricant. Alternatively, the motor may filled with a dielectric lubricant and the dielectric fluid within the interior of the tube of the motor lead may be sealed from the dielectric lubricant.

7 Claims, 3 Drawing Sheets

HERMETICALLY SEALED MOTOR LEAD TUBE

CROSS-REFERENCE TO RELATED INVENTION

This application claims priority to provisional patent application 60/971,199, filed Sep. 10, 2007.

FIELD OF THE INVENTION

This invention relates in general to electrical submersible pump assemblies for hydrocarbon well production, in particular to a motor lead for the pump assembly that is encased within a tube filled with a dielectric fluid.

BACKGROUND OF THE INVENTION

Offshore hydrocarbon production wells may be located in water thousands of feet deep. Some wells have inadequate internal pressure to cause the well fluid to flow to the sea floor and from the sea floor to a floating production vessel at the surface. Though not extensively used yet, various proposals exist to install booster pumps at the sea floor to boost the pressure of the well fluid.

U.S. Pat. No. 7,150,325 discloses installing a submersible rotary pump assembly in a caisson at the sea floor. The caisson has an inlet connected to a production unit, such as a subsea production tree, and an outlet leading to a second production unit, such as a manifold. The pump assembly is located within a capsule in the caisson in a manner that allows the capsule, with the pump therein, to be installed and retrieved from the caisson with a lift line. That solution has its merits, but does require constructing a caisson or using an abandoned well.

Flowline jumpers are commonly employed to connect various sea floor production units to each other. A flowline jumper is a pipe having connectors on its ends for connection to inlets and outlets of the production units. It is known to install a flowline jumper by lowering it from a vessel on a lift line and using a remote operated vehicle (ROV) to make up the connections. Flowline jumpers may have U-shaped expansion joints with the connectors on downward extending legs for stabbing into receptacles of the production units. Generally, a flowline jumper is simply a communication pipe and contains no additional features for enhancing production.

SUMMARY OF THE INVENTION

The subsea production system of this invention includes a pump flowline jumper having connectors at upstream and downstream ends for connection between first and second production receptacles on the sea floor. A submersible pump assembly is mounted within the pump flowline jumper prior to installing the flowline jumper. The pump flowline jumper with the pump assembly contained therein is lowered on a lift line and connected to the first and second receptacles.

A power cable leads from the surface or from a subsea power source to one or more penetrators that extend sealingly through the bulkhead of the jumper. The power cable has three conductors for supplying the three-phase power and each is connected to a conductor rod of the penetrator. A motor lead extends within the jumper housing from the penetrator to the motor. The motor lead includes one or more tubes located within the interior of the jumper housing. In one embodiment, three separate tubes are employed. The tubes are metal, such as stainless steel or Monel. The opposite end of each tube joins a tubular motor connector at the forward end of motor.

Each tube is sealingly joined to one of the motor connectors. Each motor connector comprises a tube that is fixed to the housing of the motor. In a first embodiment, there are no seals between the motor connector and the interior of the housing. Motor lubricant within the housing is free to flow into each motor connector and each tube. A power conductor extends through each tube and through each motor connector. The power conductor includes a copper wire and has one or more insulation layers surrounding the copper wire.

In a second embodiment, the annular space surrounding the conductor within each tube is filled with dielectric grease. The motor lubricant and the grease are in contact with each other, which equalizes the pressure of the dielectric grease with that of the dielectric motor lubricant.

In a third embodiment, each motor connector is a tubular member, but its interior is sealed by a seal from the interior lubricant within the motor housing. Preferably, each tube is filled with a dielectric liquid or grease that is isolated from the motor lubricant by the seal. Optionally, a pressure compensator may be located in a port provided in each motor connector to equalize the pressure of the dielectric liquid within the motor lead tube with that of the exterior.

In addition, although three separate motor lead tubes, one for each phase, are preferred, a single tube could be employed.

DETAILED DESCRIPTION OF THE INVENTION

Figure 1:
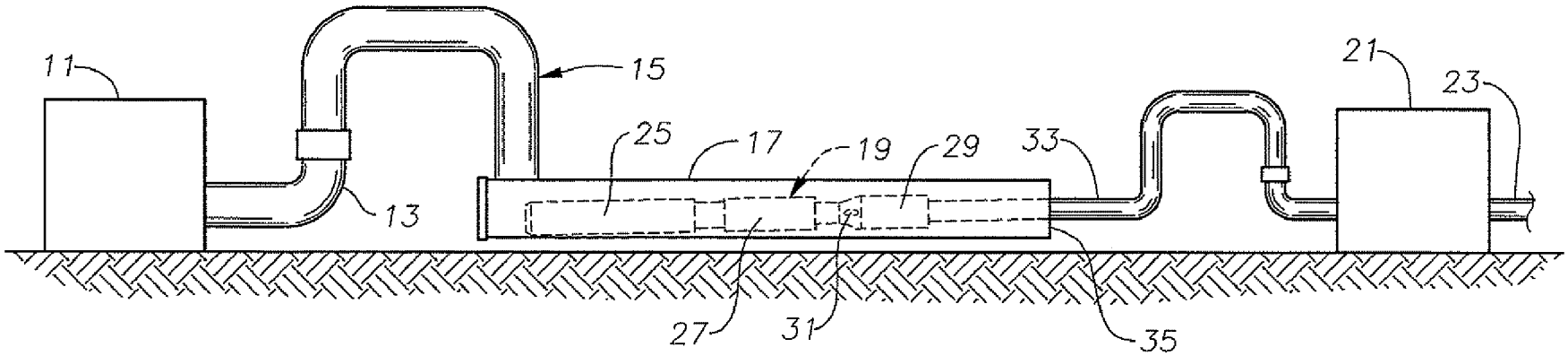
FIG. 1 is a schematic side view of a submersible pump assembly installed within a flowline jumper located between a subsea production tree and a manifold.

Referring to FIG. 1, a subsea production tree 11 is schematically illustrated. Tree 11 is a production unit located at the upper end of a well and has pressure control equipment for controlling the well fluid flow from the well. The pressure control equipment includes a number of valves, typically hydraulically actuated, and an adjustable choke for controlling the back pressure of the flowing well fluid. Tree 11 has a production flow receptacle or outlet 13. Tree 11 is located on a sea floor and is remotely controlled.

Outlet 13 is connected to a flowline jumper 15. Flowline jumper 15 has a horizontal section or housing 17 containing an electrical submersible pump assembly (ESP) 19. The opposite end of flowline jumper 15 connects to other subsea production equipment, which in this example comprises a manifold 21. Manifold 21 has a production outlet 23 that leads to well fluid processing equipment, which may be on a floating production vessel or located subsea.

ESP 19 serves to boost the pressure of the flow of well fluid flowing from production tree 11 to manifold 21. ESP 19 has an electrical motor 25, which is normally a three-phase AC motor. Motor 25 is connected to a seal section 27. Seal section 27 equalizes the pressure of lubricant within motor 25 to the pressure of the well fluid flowing into jumper housing 17. Seal section 27 is connected to a pump 29, which is typically a centrifugal pump having a large number of stages of impellers and diffusers. Pump 29 has an intake 31 for drawing in well fluid that flows into the interior of jumper housing 17. Pump 29 has a discharge tube 33 that extends sealingly through a bulkhead 35 at the end of jumper housing 17. Discharge tube 33 is connected to manifold 21.

Figure 2:
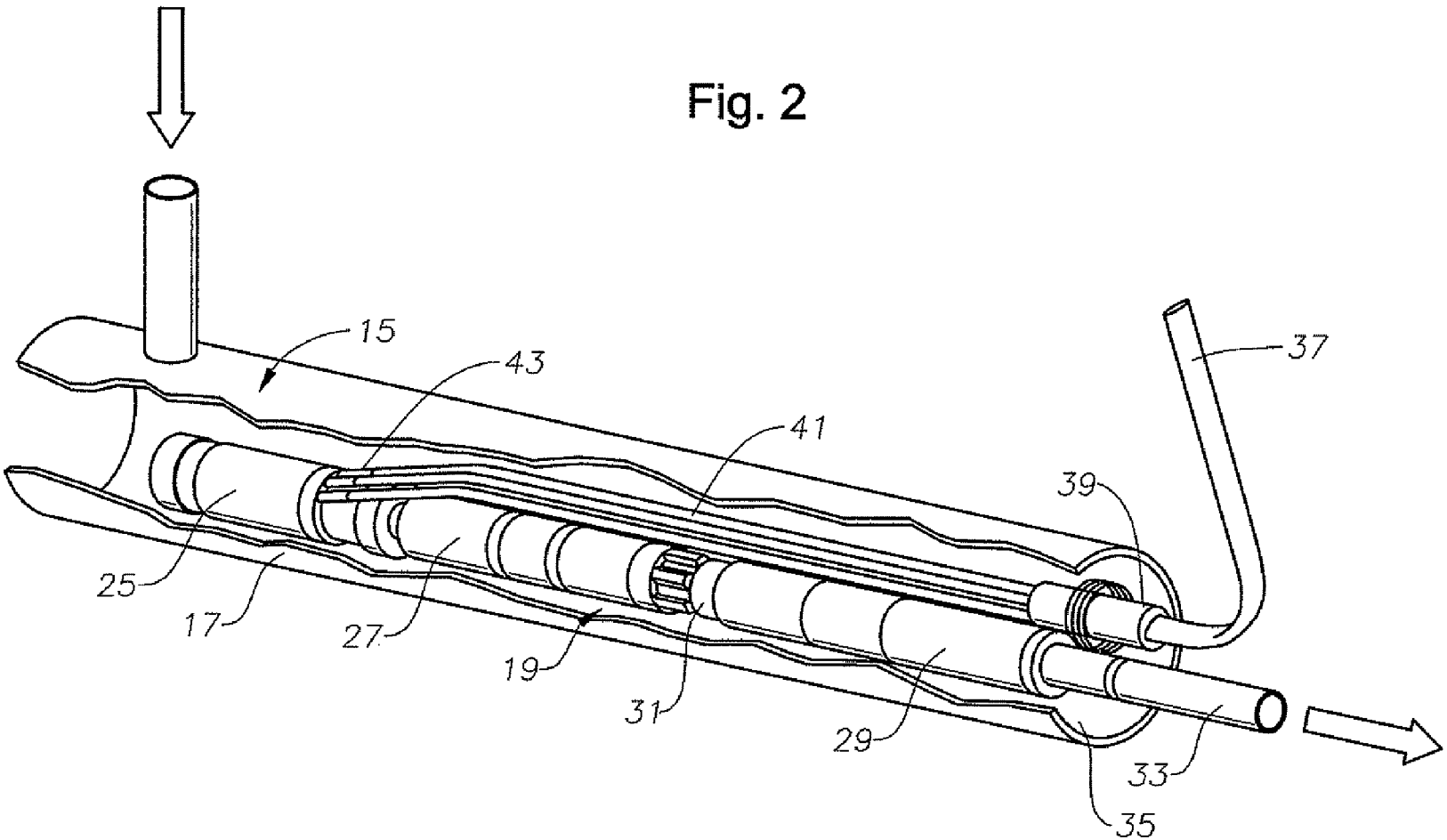
FIG. 2 is a perspective view of the pump assembly of FIG. 1.

A power cable 37 leads from the surface or from a subsea power source to one or more penetrators 39 that extend sealingly through bulkhead 35. Power cable 37 has three conductors for supplying the three-phase power and each is connected to a conductor rod of penetrator 39. A motor lead extends within jumper housing 17 from penetrator 39 to motor 25. The motor lead includes one or more tubes 41 located within the interior of jumper housing 17. In the embodiment of FIG. 2, three separate tubes 41 are employed. Tubes 41 are metal, such as of stainless steel or Monel. The opposite end of each tube 41 joins a tubular motor connector 43 at the forward end of motor 25.

Figure 3:
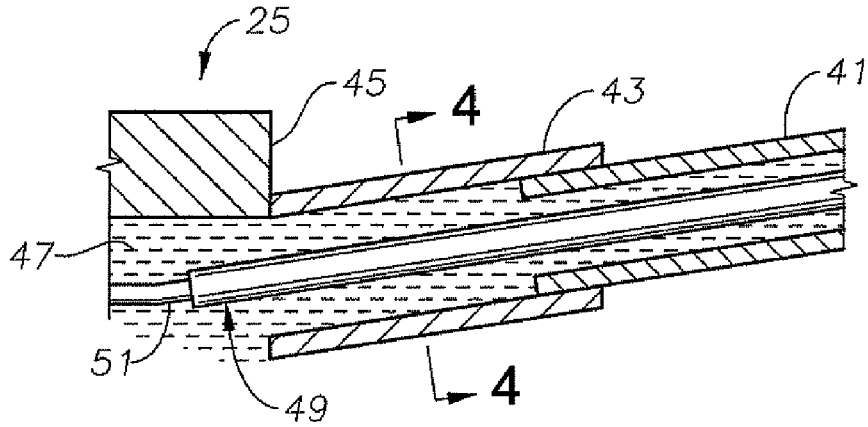
FIG. 3 is an enlarged sectional view of one of the motor leads at a point where the motor lead joins the motor housing.

Referring to FIG. 3, each tube 41 is sealingly joined to one of the motor connectors 43. Each motor connector 43 comprises a tube that is fixed to housing 45 of motor 25. In a first embodiment, there are no seals between motor connector 43 and the interior of housing 45. Motor lubricant 47 within housing 45 is free to flow into each motor connector 43 and each tube 41. In FIG. 3, a power conductor 49 extends through each tube 41 and through each motor connector 43. Power conductor 49 includes a copper wire 51 that has one end connected to the windings (not shown) of motor 25. The opposite end of power conductor 49 connects to one of the conductor rods of penetrator 39. Power conductor 49 has one or more insulation layers 53 surrounding copper wire 51, as shown in FIG. 4.

Figure 4:
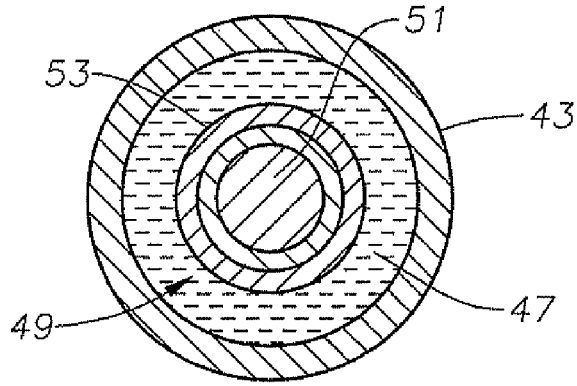
FIG. 4 is a sectional view of the motor lead of FIG. 3, taken along the line 4-4 of FIG. 3.

As illustrated by FIG. 4, in the first embodiment, motor lubricant 47 is free to flow into the annular space between conductor 49 and tube 41. The opposite end of tube 41, at penetrator 39 (FIG. 2), is sealed. Seal section 27 of ESP 19 (FIGS. 1 and 2) will equalize the pressure of motor lubricant 47 with the well fluid in housing 17 on the exterior of motor 25. The pressure of lubricant 47 within each tube 41 is thus at the same pressure as lubricant 47 within motor housing 45. This pressure is substantially equal to the exterior pressure of the well fluid surrounding each tube 41.

In a second embodiment (not shown), the annular space surrounding conductor 49 within each tube 41 is filled with a dielectric grease, which has more viscosity than motor lubricant 47. Motor lubricant 47 and the grease are in contact with each other, which equalizes the pressure of the dielectric grease with that of the dielectric motor lubricant 47.

Figure 5:
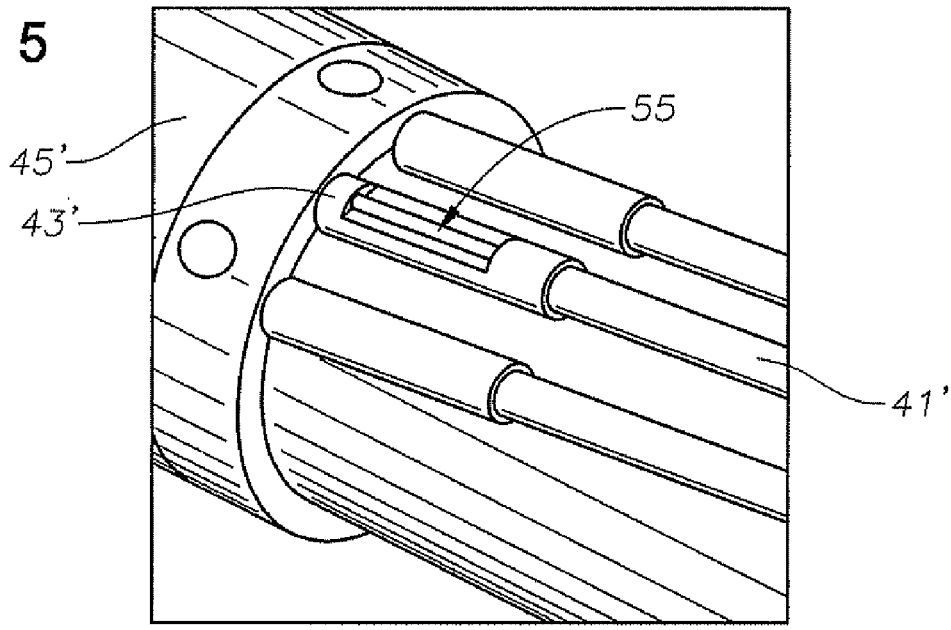
FIG. 5 is an enlarged perspective view of an alternate embodiment of the motor lead for the electrical submersible pump of FIG. 1.

In a third embodiment, illustrated in FIG. 5, each motor connector 43' is still a tubular member, but its interior is sealed by a seal (not shown) from the interior lubricant 47 (FIG. 3) within motor housing 45'. Preferably, each tube 41' is filled with a dielectric liquid or grease that is isolated from motor lubricant 47 by the seal. Optionally, a pressure compensator 55 may be located in a port provided in each motor connector 43' to equalize the pressure of the dielectric liquid within motor lead tube 41' with that of the exterior. Pressure compensator 55 may be of a variety of types, but would typically include a flexible diaphragm that separates the well fluid on the exterior from the dielectric fluid contained within tube 41'. Pressure compensator 55 would not be required if tube 41' had adequate strength to withstand the exterior pressure surrounding it.

In addition, although three separate motor lead tubes 41, one for each phase, are preferred, a single tube could be employed. In that embodiment (not shown), the single tube would contain all three conductors 49 and would preferably be filled with dielectric fluid surrounding the conductors. The fluid could be in communication with the dielectric fluid 47 in motor 45. Alternately, the dielectric fluid within the tube could be sealed from the motor lubricant and pressure compensated as in FIG. 5.

The invention claimed is:

1. An electrical submersible pump assembly, comprising:

a motor cooperatively engaged with a pump for driving the pump;

a power cable;

a motor lead exterior of the motor, the motor lead having a second end electrically connected to the motor and a first end electrically connected to the power cable for supplying power to the motor, the motor lead comprising solid electrical conductor covered by a layer of insulation and enclosed within a tube, the tube being sealed from an exterior environment of the motor, the tube and the layer of insulation having a space between them containing a dielectric fluid in contact with the layer of insulation, the space being open at the first end of the tube and closed at the second end of the tube;

wherein the motor is filled with a dielectric lubricant and the dielectric fluid in the interior of the tube of the motor lead from the first end to the second end of the tube is in fluid communication with the dielectric lubricant;

a tubular housing enclosing the motor and the pump, the housing having an intake for receiving well fluid, the pump having a pump intake within the housing for receiving the well fluid flowing into the housing and a discharge conduit extending sealingly out of the housing; and the power cable extending to an exterior end of a penetrator mounted in a portion of a wall of the housing, wherein the tube extends within the housing from the motor to an interior end of the penetrator, the tube adapted to be immersed in well fluid flowing into the housing to the pump intake and being located exterior of the discharge conduit, and wherein the penetrator seals the space between the layer of insulation and the tube, preventing any of the dielectric fluid from flowing past the penetrator into the power cable.

2. The pump assembly according to claim 1, wherein the dielectric fluid within the tube comprises the dielectric lubricant.

3. The pump assembly according to claim 1, wherein the dielectric fluid within the tube comprises a grease.

4. The pump assembly according to claim 1, wherein the closed second end of the tube prevents the dielectric fluid from flowing out the second end of the tube.

5. An electrical submersible pump assembly, comprising:

a motor cooperatively engaged with a pump for driving the pump;

a subsea tubular flowline jumper housing enclosing the motor and the pump, the housing having an intake adapted to be coupled to a subsea production outlet for receiving well fluid, the pump having an intake within the housing for receiving the well fluid and a discharge conduit extending sealingly out of the housing, the discharge conduit adapted to be coupled to a subsea flowline;

a power cable for connection to a power source exterior of the housing and extending to an exterior end of a penetrator sealingly mounted in a portion of a wall of the housing;

a motor lead extending within the housing from the motor to an interior end of the penetrator for supplying power to the motor, the motor lead comprising an electrical conductor comprising a solid copper wire covered with an insulation layer and enclosed within a metal tube that is exterior of the discharge conduit, the insulation layer having an exterior smaller than an interior of the tube, defining a space between the insulation layer and the tube, the space having an open end at the motor and a closed end at the penetrator, the tube being immersed in the well fluid flowing into the housing to the intake of the pump, and the space containing a dielectric fluid; and wherein the motor is filled with a dielectric lubricant and the dielectric fluid within the interior of the tube of the motor lead in a portion of the tube exterior of the motor is in fluid communication with the dielectric lubricant.

6. The pump assembly according to claim 5, wherein the dielectric fluid within the tube comprises the dielectric lubricant.

7. A pump assembly, comprising:

an electrical motor filled with a dielectric lubricant and cooperatively engaged with a pump for driving the pump;

a tubular housing enclosing the motor and the pump, the housing having an intake for receiving well fluid, the pump having a pump intake within the housing for receiving the well fluid and a discharge conduit extending sealingly out of the housing;

a power cable for connection to a power source exterior of the housing and extending to an exterior end of a penetrator sealingly mounted in a portion of a wall of the housing;

a metal tube extending within the housing from the motor to the penetrator, the tube being located exterior of the discharge conduit and adapted to be immersed in well fluid flowing into the housing to the pump intake; and a solid electrical conductor having a layer of insulation located within the tube and extending from the motor to the penetrator to supply power to the motor, the insulation having an outer diameter smaller than an inner diameter of the tube, defining an annular space with an open end at the motor and a closed end at the penetrator, the annular space being filled with dielectric lubricant and in fluid communication with the dielectric lubricant contained in the motor.

* * * * *